United States Patent [19]

Black

[11] 4,235,034

[45] Nov. 25, 1980

[54] REMOVABLE SIGN POST HOLDING APPARATUS

[76] Inventor: John W. Black, 1940 Papago, Sheridan, Wyo. 82801

[21] Appl. No.: 71,767

[22] Filed: Aug. 31, 1979

[51] Int. Cl.[3] ..... G09F 7/18

[52] U.S. Cl. ..... 40/607; 248/156; 248/530; 248/545

[58] Field of Search ..... 40/607, 608; 248/545, 248/530, 532, 533, 85, 86, 87, 88, 156

[56] References Cited

U.S. PATENT DOCUMENTS

| | | | |
|---|---|---|---|
| 2,759,486 | 8/1956 | Pesaturo | 248/545 X |
| 3,342,444 | 9/1967 | Nelson | 248/530 X |
| 3,820,750 | 6/1974 | Deike | 248/156 X |
| 3,843,079 | 10/1974 | Reisling | 248/530 |

FOREIGN PATENT DOCUMENTS

| | | | |
|---|---|---|---|
| 374270 | 6/1932 | United Kingdom | 40/607 |
| 581915 | 10/1946 | United Kingdom | 248/156 |

*Primary Examiner*—John F. Pitrelli
*Attorney, Agent, or Firm*—Arthur L. Urban

[57] ABSTRACT

A removable sign post holding apparatus including a body portion having a post-receiving opening, a plurality of ground-engaging sections extending downwardly from the periphery of the body portion, a connector section extending outwardly from the said body portion, an opening in the connector section, a removable cap portion engageable with the post-receiving opening of the body portion, the said cap portion including an anvil section of a size larger than the opening of the body portion, a plurality of flange sections extending from the anvil section, the flange sections being of a length adjacent the anvil section to mate with the corresponding portion of the body portion with which it is engageable.

12 Claims, 6 Drawing Figures

REMOVABLE SIGN POST HOLDING APPARATUS

This invention relates to a novel apparatus for holding a sign post in position and more particularly relates to a new apparatus for holding a sign post which permits the post and the apparatus to be removed.

Through the years, signs have been used for a variety of purposes. Signs have been employed for the display of notices, for advertising and the like. the use of signs has become an accepted media for conveying information in modern society.

One of the problems in the use of signs is how to properly position the sign to attract attention of passersby. If a wall, fence or other surface is conveniently located, the sign can be mounted thereon. However, if such a surface is not available, other expedients must be utilized.

Many signs which must be positioned away from other surfaces are mounted on sign posts. The sign posts must be secured in an upright position by one means or another. Usually, this involves burying the end of the post in the ground. To achieve this result, it generally is necessary to dig a hole in which to place the bottom of the post.

Digging a hole often can present problems. For example, the digging is a dirty task which at the least may result in the digger's hands becoming soiled and frequently results in the digger's clothes and shoes also becoming soiled. This can be very frustrating as well as require extra effort either in cleaning the body and clothes after the hole has been dug and/or changing into work clothes to dig the hole and then changing back to dress clothes.

Other problems in digging a hole for a sign post are the skill and tools required to dig a proper hole. If care is not exercised in the digging, the post will not be secured in an upright position but will lean at an undesirable angle. This can occur when the hole is too large and/or the hole is not properly backfilled after placing the post. An oversize hole often results if the shovel is too large for the hole to be dug. or if the digger is not careful as he does the digging Another undersirable factor to be considered in placing signs by burying te sign post is the physical effort necessary to dig the hole and position the post. Many people, and particularly elderly persons and women, may be incapable of accomplishing this task.

Even when it is possible to dig a hole and position the sign post, the question remains as to what to do with the excess soil remaining after the hole is backfilled. If the sign is permanent, the soil can be discarded. However, if the sign is temporary, removal of the soil usually is not desirable since it must be brought back later to fill the empty hole after the post is removed. On the other hand, if the soil is kept at the sign post, it either is piled around the base of the post or else stored nearby. In either case, the excess soil often is unsightly and detracts from the appearance of the sign.

A further consideration is how to remove the sign and post when it is no longer needed. Generally, the better the post is set initially, the more difficult it is to remove later. Thus, the individual placing the sign is faced with a dilemma. Shall the sign post be placed as securely as possible initially so that the sign will not shift and appear unsightly even though extra effort will be required to remove the post when no longer needed or alternatively, should the sign post be placed less securely at the start to facilitate easy removal of the post later. While one of the above choices may be acceptable in some situations, in others, neither solution is desirable, with each having serious drawbacks. Thus, the solution selected at best is a compromise that is neither desirable nor satisfying.

In view of the drawbacks of setting sign posts by digging holes, other sign positioning methods have been proposed. It has been suggested that bases be constructed so that the bottom of the sign post simply rest on the surface of the ground rather than being buried. This requires some type of base. Such bases must be of a design that will maintain the sign in proper position even if exposed to disturbing influences such as wind, passersby and the like. This requires that the base be substantial in size and weight. Some bases are heavy metal such as auto wheels, while others are crossbraces which extend outwardly from the bottom of the post. Both of these expedients, however, involve considerable extra handling and storage space when not being used. Furthermore, the bases generally are not readily available and thus must be constructed or adapted by hand at considerable cost and effort. From the above discussion, it is apparent that none of the presently available sign post positioning methods are satisfactory in many situations.

The present invention provides a novel apparatus for holding a sign post in position. The sign post holding apparatus of the invention provides a simple and convenient means for positioning a sign post. The sign post holding apparatus maintains the post securely in position, while permitting the post to be removed easily when the sign is no longer needed.

The sign post holding apparatus of the present invention can be installed and removed quickly and conveniently. The installation and removal can be accomplished with a minimum of effort. In addition, use of the sign post holding apparatus eliminates the necessity for storing or removing excess soil.

The sign post holding apparatus of the invention is simple in design and relatively inexpensive to manufacture. The apparatus can be fabricated from commercially available materials. Furthermore, the apparatus can be fabricated utilizing conventional metal working techniques. Also, the sign holding apparatus can be produced by semi-skilled workers.

Other benefits and advantages of the novel sign post holding apparatus will be apparent from the following description and the accompanying drawings in which.

Figure 1:
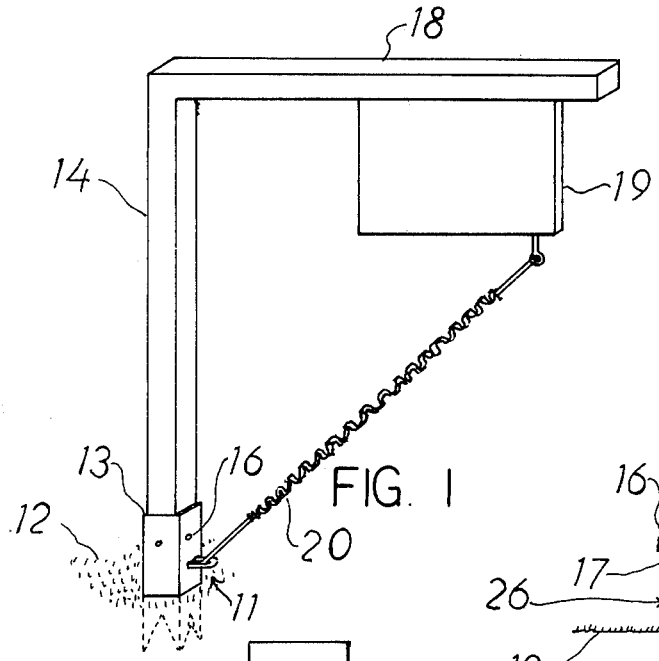
FIG. 1 is a view in perspective of one form of the sign post holding apparatus of the invention in use with a sign.

As shown in the drawings, one form of the novel sign post holding apparatus of the present invention is forced into the ground 12 with a post-receiving opening 13 thereof projecting upwardly. A sign post 14 has its lower or bottom portion 15 inserted into the opeing 13. The post 14 may be secured therein advantageously with suitable fasteners such as nails 16 that extend through openings 17 of the apparatus and into the bottom portion 15 of the post 14. Preferably, the nails 16 are double-headed nails for easy removal.

A crossmember 18 is affixed to the upper portion of the post 14. The crossmember 18 extends outwardly from the post 14 and a suitable sign 19 is suspended from the crossmember. The sign 19 advantageously is connected to the sign post holding apparatus 11 through connecting means shown in FIGS. 1 and 2 as an elastic cord 20 with hooks 21 on the ends thereof. One hook 21 engages a connector section 22 extending outwardly from the sign post holding apparatus 11. The other hook 21 engages the lower edge of sign 19, e.g., through a suitable anchor such as eye 24.

The sign post holding apparatus 11 of the invention advantageously includes a body portion 26 with a number of flat surfaces 27. Preferably, the post-receiving opening 13 of the body portion 26 is substantially square.

The sign post holding apparatus 11 also includes a plurality of ground-engaging sections 28 which extend downwardly from the periphery of the body portion 26. The ground-engaging sections 28 advantageously are integral with the body portion as a unitary structure as shown in the drawings. Preferably, the ground-engaging sections 28 of the apparatus 11 are tapered toward and extend along the junctures of the flat surfaces which form the body portion 26.

The connector secton 22 which extends outwardly from the apparatus 11 advantageously is located adjacent the juncture of the body section 26 and the ground-engaging sectons 28 thereof.

The sign post holding apparatus 11 of the invention also includes a removable cap portion 30 which is engageable with the post-receiving opening 13 of the body portion 26. The cap portion 30 includes an anvil section 31 of a size larger than the opening 13 of the body portion 26. A plurality of flange sections 32 extend from the anvil section 31. The flange sections 32 are of a length adjacent the anvil section 31 to mate with the corresponding part of the body portion 26 with which it is engageable.

Preferably, the anvil section 31 of the cap portion 30 is of the same configuration as the opening 13 of the body portion 26, but larger. For example, as shown, when the opening 13 is square, the anvil secton 31 also will be square in shape. Advantageously, the flange sections 32 of the cap portion 30 are of a length adjacent the anvil section 31 less than the corresponding part of the body porition 26 so that the flange section 32 will be engageable with the interior surface of the body portion.

Figure 2:
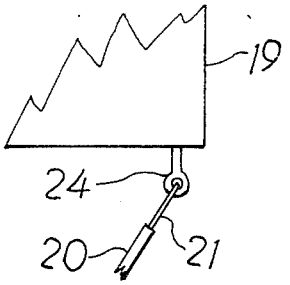
FIG. 2 is an enlarged side view of the sign post holding apparatus shown in FIG. 1.
Figure 2:
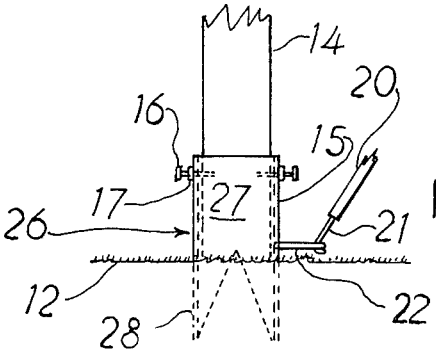
Figure 3:
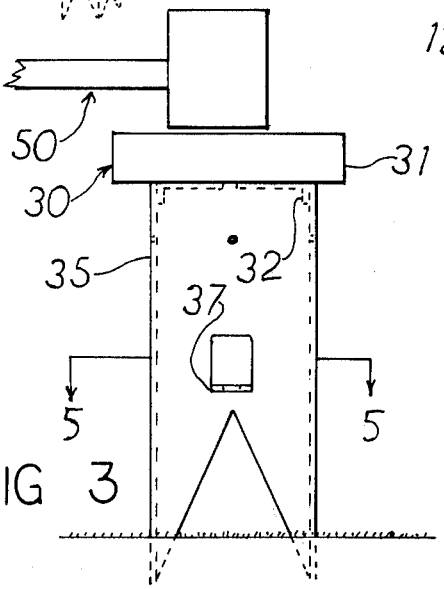
FIG. 3 illustrates another form of the sign post holding apparatus of the invention being placed in the ground.

FIG. 3 which illustrates another form of the apparatus of the present invention shows the cap portion 30 in position on a body portion 35. Body poriton 35 includes a connector section 37 bent to extend outwardly from the body poriton. Section 37 has an opening 38 for fastening a connector such as cord 20 of FIGS. 1 and 2.

Figure 4:
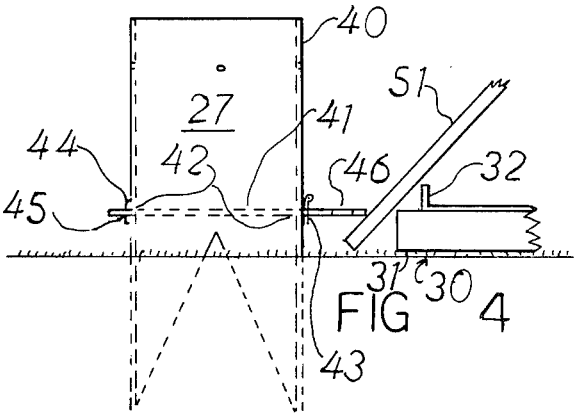
FIG. 4 illustrates a further form of the sign post holding apparatus of the invention being removed from the ground when no longer needed.
Figure 5:
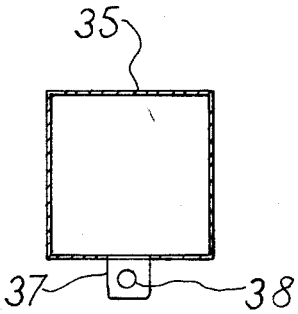
FIG. 5 is a sectional view taken along line 5—5 of FIG. 3.
Figure 6:
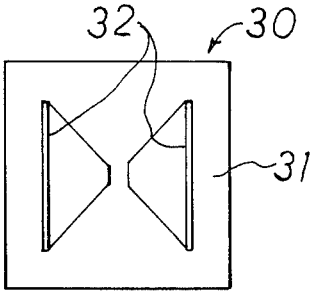
FIG. 6 is a bottom view of the cap portion of the sign post holding apparatus shown in FIG. 3

In FIG. 4, a different form of the apparatus of the invention is shown. A body portion 40 has a bar member 41 that extends through openings 42 in opposite sides of the body portion. Bar member 41 has a shoulder or enlarged section 43 adjacent one opening 42 in the body portion 40. This shoulder 43 in combination with fastener 44 extending through an opening 45 in bar member 41 prevents shifting of the bar member. Bar member 41 also includes an opening 46 in the part thereof extending beyond shoulder 43 for connection to a connector such as cord 20 as described with regard to FIGS. 1 and 2.

In the use of the sign post holding apparatus of the present invention as shown in the drawings, cap portion 30 is positioned over the body portion of the apparatus with the flange sections 32 extending downwardly through the post-receiving opening. Anvil section 31 bears against the upper edge of the body portion 35 as shown in FIG. 3 so that a hammer or sledge 50 can be utilized to drive the ground-engaging sections 36 thereof into the ground. The apparatus is driven into the ground to an extent that connector section 37 will be close to the surface thereof to help stabilize the structure.

When the apparatus has been driven into the ground to the desired level, cap portion 30 is removed from the body portion 35 and the lower portion 15 of sign post 14 inserted into the post-receiving opening 13 as shown in FIGS. 1 and 2. The post 14 has crossmember 18 and sign 19 affixed thereto. Next nails 16 are driven through openings 17 and into the post 14. Thereafter, one hook of cord 20 is attached to connector section 22 and the opposite hook of the cord attached to eye 24 affixed to the lower edge of sign 19.

When it is desired to remove the sign and post, nails 16 are removed fom the openings 17 in the apparatus, the cord unhooked and the bottom of the post 14 withdrawn. To remove the apparatus from the ground, cap portion 30 may be used as a fulcrum as shown in FIG. 4. The cap portion 30 is positioned close to the connector secton 41 with the anvil section 31 in contact with the ground and the flange sections 32 extending upwardly. The end of a bar 51 or a sledge handle or the like may be placed under the connector section 41 and the apparatus pried from the ground using the cap portion as a fulcrum. After the apparatus is removed, the ground may be restored by tamping with a shoe.

The above description and the drawings show that the present invention provides a novel apparatus for holdig a sign post in position. The sign post holding apparatus of the invention provides a simple and convenient means for positioning a sign post. Not only does the sign post holding apparatus maintain the sign post securely against deflection, but also the apparatus can be removed easily from the ground when the sign is no longer needed.

The sign post holding apparatus of the present invention can be installed quickly and conveniently and can be removed just as quickly and conveniently. The installation and removal can be accomplished easily with a minimum of effort and without digging any holes. Since no holes are dug there is no need to handle any dirt and so the installation and removal can be done without getting clothes or person dirty. In addition, use of the sign post holding apparatus of the invention eliminates the need for removing or storing excess dirt.

The sign post holding apparatus of the invention is simple in design and relatively inexpensive to manufacture. The apparatus can be fabricated from commercially available materials employing conventional metal-working techniques by semi-skilled workers.

It will be apparent that various modifications can be made in the particular sign post holding apparatus described in detail above and shown in the drawings within the scope of in invention. For example, the size and configuration of the components of the apparatus can be changed to meet specific requirements provided the functioning and operation of the apparatus is not adversely affected. While the apparatus of the invention ordinarily is fabricated of heavy steel tubing, with certain soil conditions and smaller size signs, it may be desirable to fabricate the apparatus of materials having less strength such as aluminum or some other material. Therefore, the scope of the invention is to be limited only by the following claims.

What is claimed is:

1. A removable sign post holding apparatus including a body portion having a post-receiving opening, a plurality of ground-engaging sections extending downwardly from the periphery of said body portion, a connector section extending outwardly from said body portion, an opening in said connector section, a removable cap portion engageable with the post-receiving opening of said body portion, said cap portion including an anvil section of a size larger than the opening of said body portion, a plurality of flange sections extending from said anvil section, said flange sections being of a length adjacent said anvil section less than the corresponding portion of said body portion and are engageable with a surface of said corresponding portion.

2. A removable sign post holding apparatus according to claim 1 wherein said body portion has a number of flat surfaces.

3. A removable sign post holding apparatus according to claim 2 wherein said body portion has a substantially square post-receiving opening

4. A removable sign post holding apparatus according to claim 2 wherein said ground-engaging sections of said apparatus are tapered and extend along the junctures of said flat surfaces.

5. A removable sign post holding apparatus according to claim 4 wherein said tapered ground-engaging section are integral with said body portion as a unitary structure.

6. A removable sign post holding apparatus according to claim 1 wherein said connector section extends outwardly from said body portion at a point thereon adjacent the juncture of said body portion with said ground-engaging sections.

7. A removable sign post holding apparatus according to claim 1 wherein said connector section is an eye member affixed to said body portion and extending substantially perpendicular therefrom.

8. A removable sign post holding apparatus according to claim 1 wherein said connector section is a section of said body portion bent to extend outwardly therefrom.

9. A removable sign post holding apparatus according to claim 1 wherein said connector section is a bar member extending through openings in opposite sides of said body portion.

10. A removable sign post holding apparatus according to claim 1 wherein said anvil section of said cap portion is of the same configuration as the opening of said body portion but larger.

11. A removable sign post holding apparatus according to claim 2 wherein said flange sections of said cap portion are engageable with the interior surface of said corresponding portion.

12. A removable sign post holding apparatus according to claim 1 including a plurality of openings in said body portion intermediate the ends thereof, said openings providing passages between the interior and exterior of said body portion.

* * * * *